US011696873B2

(12) United States Patent
Gu et al.

(10) Patent No.: US 11,696,873 B2
(45) Date of Patent: Jul. 11, 2023

(54) MEDICINE BOX

(71) Applicant: Zhenyu Gu, Shanghai (CN)

(72) Inventors: Zhenyu Gu, Shanghai (CN); Jinsu Chen, Shanghai (CN); Zhangheng Xue, Shanghai (CN)

(73) Assignee: Zhenyu Gu, Shanghai (CN)

( * ) Notice: Subject to any disclaimer, the term of this patent is extended or adjusted under 35 U.S.C. 154(b) by 409 days.

(21) Appl. No.: 17/053,794

(22) PCT Filed: Feb. 1, 2019

(86) PCT No.: PCT/CN2019/074407
§ 371 (c)(1),
(2) Date: Jul. 16, 2021

(87) PCT Pub. No.: WO2019/214302
PCT Pub. Date: Nov. 14, 2019

(65) Prior Publication Data

US 2021/0338531 A1 Nov. 4, 2021

(30) Foreign Application Priority Data

May 9, 2018 (CN) ..... 201810437540.4

(51) Int. Cl.
*A61J 7/00* (2006.01)
*A61J 1/03* (2023.01)

(52) U.S. Cl.
CPC ..... *A61J 7/0084* (2013.01); *A61J 1/03* (2013.01); *A61J 2200/30* (2013.01); *A61J 2200/70* (2013.01)

(58) Field of Classification Search
CPC ..... A61J 7/0084; A61J 1/03; A61J 2200/70; A61J 2200/30
USPC ... 221/18–19, 26–32, 64, 90, 154, 212, 303, 221/306–307, 309–310
See application file for complete search history.

(56) References Cited

U.S. PATENT DOCUMENTS 4,947,990 A * 8/1990 Klemets ..... B65D 83/0835 206/412
5,143,250 A * 9/1992 Freitag ..... B42D 5/005 221/61

(Continued)

FOREIGN PATENT DOCUMENTS

CN 101357102 A 2/2009
CN 104185511 A 12/2014

(Continued)

*Primary Examiner* — Michael Collins

(57) ABSTRACT

The present disclosure provides a medicine box, including a housing, a door, a first clamping member, and a second clamping member, a cavity is formed inside the housing, the housing has an opening on a top surface; an end of the door is rotatably connected with one side of the housing at the opening, an end of the first clamping member is connected with the other end of the door, and the other end of the first clamping member includes a first magnetic portion; an end of the second clamping member is connected with the other side of the housing at the opening, and the other end of the second clamping member includes a second magnetic portion; and a clamping area with a changeable size is formed between the first magnetic portion and the second magnetic portion.

14 Claims, 10 Drawing Sheets

(56) References Cited

U.S. PATENT DOCUMENTS

| | | | | | |
|---|---|---|---|---|---|
| 5,358,140 | A * | 10/1994 | Pellegrino | A61F 15/001 | 206/440 |
| 7,428,978 | B2 * | 9/2008 | Lewis | B65H 3/56 | 221/39 |
| 2005/0035133 | A1 * | 2/2005 | Gerulski | B26D 1/065 | 83/614 |
| 2010/0084422 | A1 * | 4/2010 | Robota | B65D 83/02 | 221/209 |
| 2013/0066463 | A1 * | 3/2013 | Luoma | G16H 20/13 | 700/232 |

FOREIGN PATENT DOCUMENTS

| | | | | |
|---|---|---|---|---|
| CN | 106420362 | A * | 2/2017 | A61J 7/04 |
| CN | 106420362 | A | 2/2017 | |
| CN | 108852827 | A | 11/2018 | |

* cited by examiner

MEDICINE BOX

BACKGROUND

Field of Disclosure

The present disclosure relates to the technical field of medical containers, in particular, to a medicine box.

Description of Related Arts

Middle-aged and elderly patients with chronic diseases need to take more than two drugs for 3-5 times a day depending on their condition, which means at least 50 pills a week. Due to memory decline and reduced mobility, middle-aged and elderly patients with chronic diseases often miss drugs or take drugs by mistake. In the process of taking chronic disease drugs for a long time, many patients with chronic diseases fail to accurately follow the doctor's instructions to take the drugs, resulting in unsatisfactory recovery.

In small community hospitals or nursing homes, it has become a complicated task to distribute medicines to the elderly with chronic diseases. The number of guardianship and volunteer workers is insufficient, and the number of caregivers and patients is seriously out of balance. When it is time for the medication to be taken, caregivers are required to manually remind patients to take specific medications. Elderly chronically ill patients without caregivers are likely to take the drugs by mistake or miss drugs. Regularly rationing and supervising drugs for patients with chronic diseases has become a heavy and complicated task in social security that is prone to errors and omissions.

To reduce the cost of drug packaging and drug prices, China has gradually begun to promote large-volume packaging of drugs. Pharmacies or hospitals purchase large-package drugs, and then allocate single-dose packaged drugs with a certain medication cycle to patients according to prescription requirements for patients. Most countries in Europe and America have adopted this approach.

At present, there are some medicine boxes for reminding the taking of medicines. Placing the divided medicines in these devices can realize automatic reminding of taking medicines. However, the existing medicine boxes have complicated structure designs and inconvenient operations, which is not conducive for patients to use.

SUMMARY

The present disclosure provides a medicine box with simple structure and convenient operation to overcome the above-mentioned defects.

The present disclosure provides a medicine box, including a housing, a door, a first clamping member, and a second clamping member, a cavity is formed inside the housing, and the housing has an opening on a top surface; an end of the door is rotatably connected with one side of the housing at the opening, an end of the first clamping member is connected with the other end of the door, and the other end of the first clamping member includes a first magnetic portion; an end of the second clamping member is connected with the other side of the housing at the opening, and the other end of the second clamping member includes a second magnetic portion; the first magnetic portion and the second magnetic portion are arranged opposite to each other and are attracted to each other by magnetic force, and a clamping area with a changeable size is formed between the first magnetic portion and the second magnetic portion.

Preferably, an end of the first clamping member away from the door extends outward to form the first magnetic portion in a direction away from the cavity, and an end of the second clamping member away from the housing extends outward to form the second magnetic portion in a direction away from the cavity.

Preferably, the first magnetic portion includes a first magnetic surface facing the cavity, the second magnetic portion includes a second magnetic surface facing the cavity, the first magnetic surface and the second magnetic surface are arranged at an angle opposite to each other, the clamping area is formed between the first magnetic surface and the second magnetic surface.

Preferably, the first magnetic portion includes a first holding portion formed by the first clamping member extending outward from an end away from the door in a direction away from the cavity and a first magnet embedded in the first holding portion, the first clamping portion includes a first clamping surface formed as the first magnetic surface, and the first magnet is arranged parallel to the first clamping surface.

Preferably, a first bottom surface at an end of the first clamping member connected with the door is smoothly and transitionally connected with the first magnetic surface of the first magnetic portion through a first arc-shaped surface.

Preferably, the second magnetic portion includes a second holding portion formed by the second clamping member extending outward from an end away from the housing in a direction away from the cavity and a second magnet embedded in the second holding portion, the second clamping portion includes a second clamping surface formed as the second magnetic surface, and the second magnet is arranged parallel to the second clamping surface.

Preferably, a second bottom surface at an end of the second clamping member connected with the housing is smoothly and transitionally connected with the second magnetic surface of the second magnetic portion through a second arc-shaped surface.

Preferably, the housing has a first limiting structure matched with the door, and the first limiting structure limits a bottom dead center position when the door rotates toward the inside of the cavity.

Preferably, the first clamping member is rotatably connected with the door.

Preferably, a second limiting structure is disposed between matching surfaces of the door and the first clamping member, and the second limiting structure limits a bottom dead center position when the first clamping member rotates toward the inside of the cavity.

Preferably, the second clamping member is rotatably connected with the housing.

Preferably, the housing and the second clamping member are matched by a third limiting structure, and the third limiting structure limits a bottom dead center position when the second clamping member rotates toward the inside of the cavity.

Preferably, a pouch counting sensor is disposed on the first magnetic portion or the second magnetic portion.

Preferably, a controller is disposed in the housing, a visible part on the housing, the door, the first clamping member, and/or the second clamping member includes an information display device, the information display device is connected with the controller, and the pouch counting sensor is connected with the controller.

Compared with the traditional technology, the present disclosure has significant progress:

The door, the first clamping member, and the second clamping member are arranged on the top surface of the housing, and the first magnetic portion and the second magnetic portion are respectively arranged on the opposite ends of the first clamping member and the second clamping member. The cavity of the housing is opened or closed through the rotation of the door. When the cavity is opened, a number of sequentially connected pouches can be placed in the cavity. When the cavity is closed by the door, the first magnetic portion and the second magnetic portion are attracted through the magnetic force, that is, the first clamping member and the second clamping member are attracted through the magnetic force. In a first aspect, the relative fixation of the door and the second clamping member and the housing can be realized, so there is no need to set an additional locking structure between the door, the second clamping member, and the housing. In a second aspect, the clamping and fixing of the pouch can also be realized, so there is no need to set an additional pouch clamping structure, which can greatly simplify the overall structure of the medicine. In a third aspect, when the pouch is extracted, the change of the relative position of the first magnetic portion and the second portion causes the magnetic flux density to change, and the magnetic force also changes. Therefore, it can form the feedback of the resistance change that is opposite to the withdrawal direction and corresponding to the shape of the pouch and that can be sensed by the hand, thereby helping the user to perceive and position the interval of the pouches.

DESCRIPTION OF COMPONENT MARK NUMBERS

Figure 1:
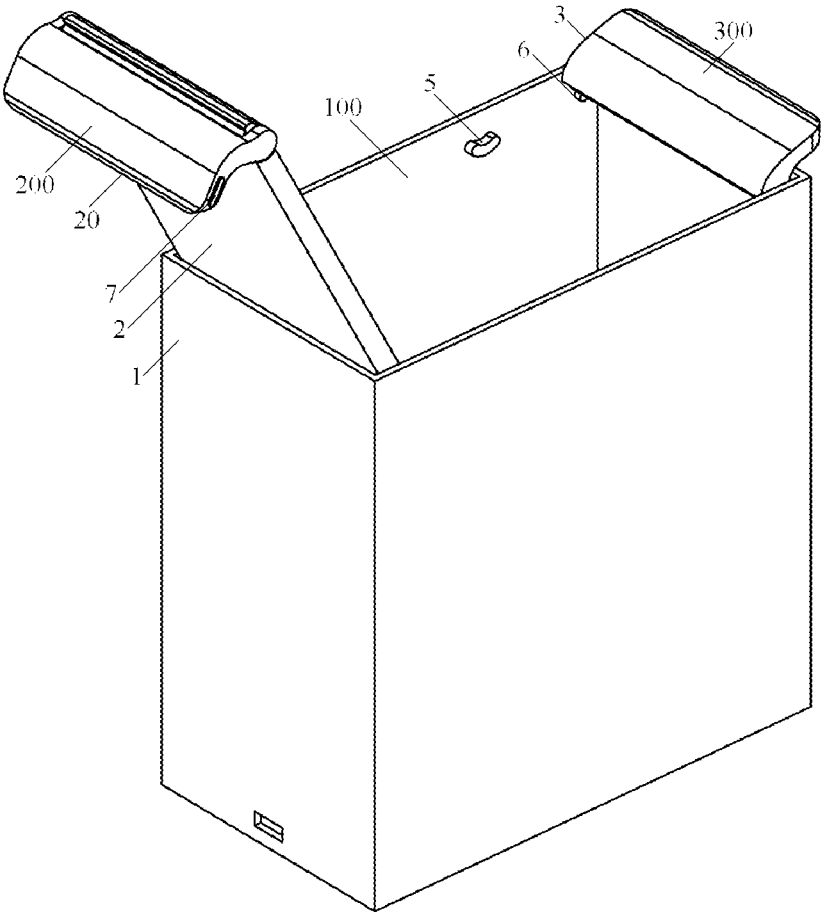
FIG. 1 shows a perspective schematic view of a medicine box when it is opened according to Embodiment 1 of the present disclosure.

| | |
|---|---|
| 1 | Housing |
| 100 | Cavity |
| 101 | Pouch |
| 2 | Door |
| 20 | First clamping member |
| 200 | First magnetic portion |
| 201 | First magnetic surface |
| 202 | First clamping portion |
| 203 | First magnet |
| 204 | First clamping surface |
| 205 | First arc-shaped surface |
| 206 | First bottom surface |
| 207 | First stepped surface |
| 208 | Second stepped surface |
| 209 | First limiting portion |
| 21 | Connecting portion |
| 3 | Second clamping member |
| 300 | Second magnetic portion |
| 301 | Second magnetic surface |
| 302 | Second clamping portion |
| 303 | Second magnet |
| 304 | Second clamping surface |
| 305 | Second arc-shaped surface |
| 306 | Second bottom surface |
| 307 | Second limiting portion |
| 4 | Clamping area |
| 5 | First boss |
| 6 | Second boss |
| 7 | Lifting gripper |
| a | Magnetic line direction of first magnetic portion |
| b | Magnetic line direction of second magnetic portion |

DETAILED DESCRIPTION OF THE PREFERRED EMBODIMENTS

The specific embodiments of the present disclosure will be described in further detail below in conjunction with the accompanying drawings. These embodiments are only used to illustrate the present disclosure and not to limit the present disclosure.

In the description of the present disclosure, it should be noted that the orientation or positional relationship indicated by the terms "center", "longitudinal", "transverse", "upper", "lower", "front", "rear", "left", "right", "vertical", "horizontal", "top", "bottom", "inner", "outer", etc. is based on the orientation or positional relationship shown in the drawings, and are only for the convenience of describing the present disclosure and simplifying the description, rather than indicating or implying that the referred device or element must have a specific orientation, be constructed and operated in a specific orientation, and therefore cannot be understood as a limitation of the present disclosure. In addition, the terms "first" and "second" are only used for descriptive purposes, and cannot be understood as indicating or implying relative importance.

In the description of the present disclosure, it should be noted that the terms "install", "connect", "couple" and other terms should be understood in a broad sense. For example, it can be a fixed connection, a detachable connection, or an integral connection. It can be a mechanical connection or an electrical connection. It can be a direct connection, or indirect connection through an intermediate medium, or it can be an internal communication between two components.

Those of ordinary skill in the art can understand the specific meanings of the above terms in the present disclosure according to specific situations.

In addition, in the description of the present disclosure, unless otherwise specified, "a plurality of" means two or more.

Embodiment 1

Figure 2:
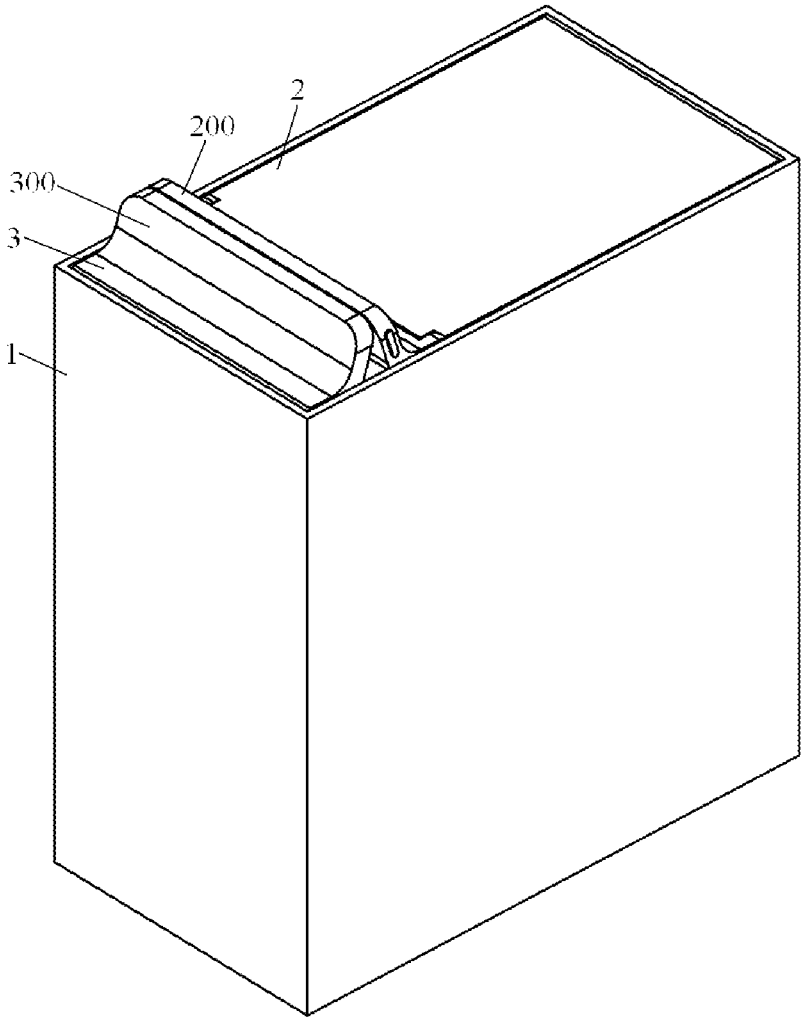
FIG. 2 shows a perspective schematic view of the medicine box when it is closed according to Embodiment 1 of the present disclosure.
Figure 3:
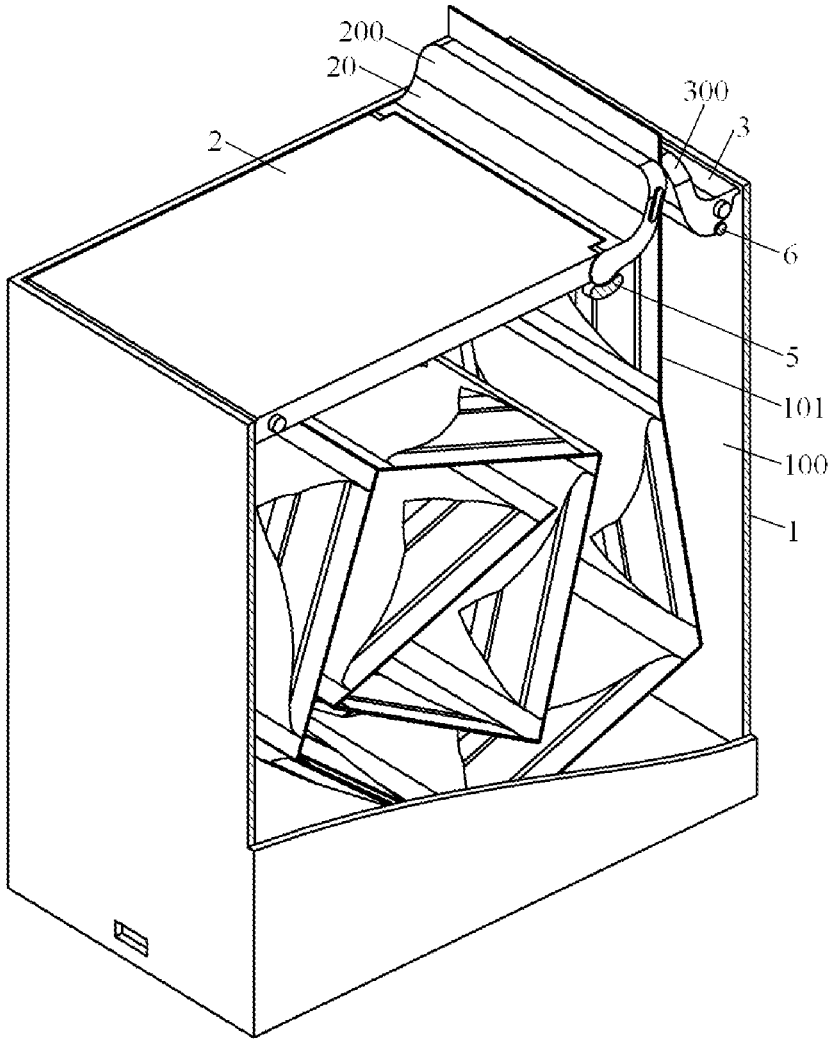
FIG. 3 shows a schematic partial cross-sectional view of the medicine box when it is closed and pouches are clamped according to Embodiment 1 of the present disclosure.

FIGS. 1 to 8*b* show the first embodiment of the medicine box of the present disclosure. The medicine box of Embodiment 1 includes a housing 1, a door 2, a first clamping member 20, and a second clamping member 3. A cavity 100 is formed inside the housing 1, the housing 1 has an opening on a top surface. As shown in FIG. 3, the cavity 100 contains several dispensed medicines. The dispensed medicines are packaged in several pouches 101 connected in sequence. Each medicine 101 contains a single dose of medicine. The shape of the housing 1 and the cavity 100 is not limited, the rectangular shape as shown in FIG. 3 may be adopted, and other shapes may also be adopted. It should be noted that the medicines contained in the pouch 101 of the present disclosure are not limited to the medicines taken by the patient, and may be other items, such as tea or sugar or other items that can be packaged in the pouch 101.

Figure 4:
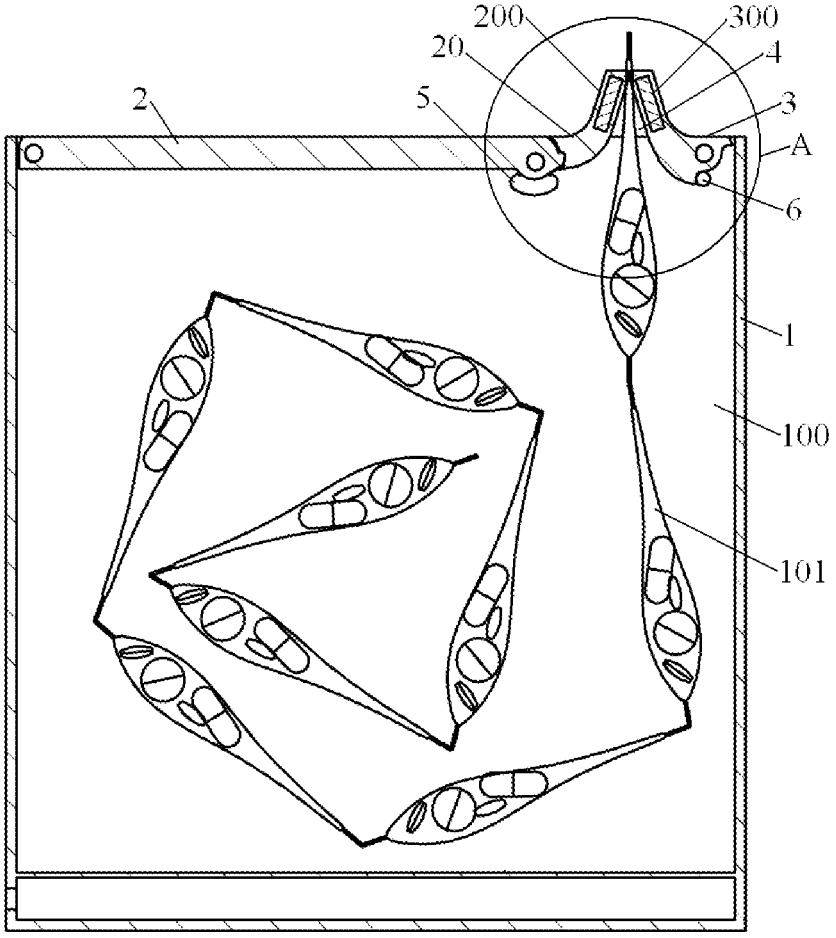
FIG. 4 shows a schematic cross-sectional view of the medicine box when it is closed and pouches are clamped according to Embodiment 1 of the present disclosure.
Figure 5:
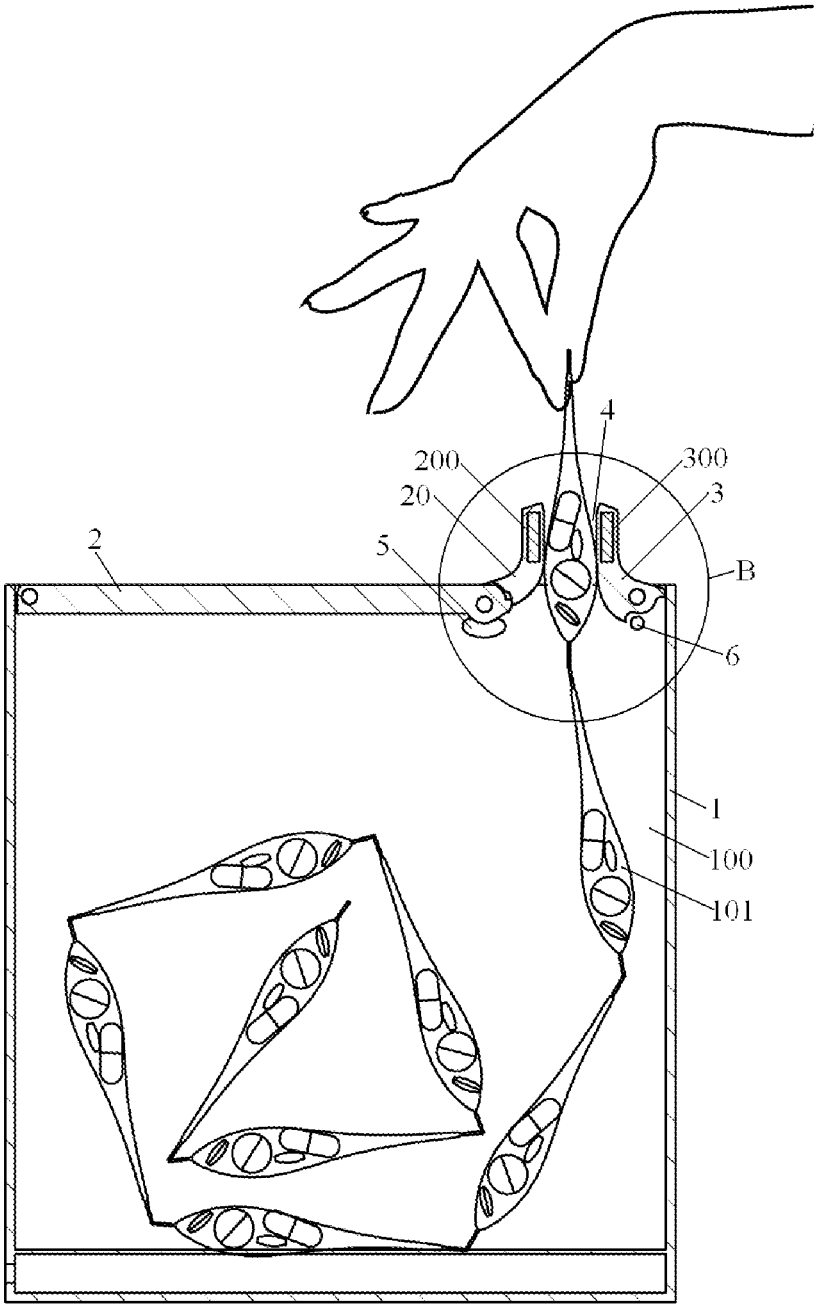
FIG. 5 shows a schematic cross-sectional view when the pouches are drawn out from the medicine box according to Embodiment 1 of the present disclosure.

As shown in FIGS. 1 and 2, in Embodiment 1, one end of the door 2 is rotatably connected with one side of the housing 1 at the opening. The rotatable connection between the door 2 and the housing 1 is not limited. For example, a pivot connection, a matching connection between a pin and a pin hole, or a hinged connection may be adopted. One end of the first clamping member 20 is connected with the other end of the door 2, and the other end of the first clamping member 20 includes a first magnetic portion 200. An end of the second clamping member 3 is connected with the other side of the housing 1 at the opening, and the other end of the second clamping member 3 includes a second magnetic portion 300. The first magnetic portion 200 and the second magnetic portion 300 are arranged opposite to each other and are attracted to each other by magnetic force. The cavity 100 may be opened (see FIG. 1) or closed (see FIG. 2) through the rotation of the door 2. Referring to FIGS. 3 and 4, when the door 2 closes the cavity 100, a clamping area 4 is formed between the first magnetic portion 200 and the second magnetic portion 300. One end of the sequentially connected pouches 101 placed in the cavity 100 may extend from the clamping area 4, and a closing pressure is generated to the pouch 101 located in the clamping area 4 through the mutual attraction between the first magnetic portion 200 and the second magnetic portion 300, thereby clamping and fixing the pouch 101. Referring to FIG. 5, the size of the clamping area 4 can be changed, and the change of the size of the clamping area 4 can be realized by the rotation of the door 2 driving the first clamping member 20 to rotate. Thus, the pouch 101 can be drawn out from the clamping area 4 to take out the medicine, and the thickness change at the clamping area 4 during the extraction process of the pouch 101 can be adapted, so that the pouch 101 can smoothly pass through the clamping area 4 when taking out medicine. After the medicine is taken out, the connection part between the pouches 101 can be clamped between the first magnetic portion 200 and the second magnetic portion 300 to facilitate taking out medicine the next time.

Preferably, the first clamping member 20 may be rotatably connected with the door 2, and the size of the clamping area 4 can be changed by rotating the first clamping member 20 relative to the door 2. The rotatable connection between the first clamping member 20 and the door 2 is not limited. For example, the first clamping member 20 may be connected with the door 2 by a pivot connection, a matching connection between a pin and a pin hole, or a hinged connection to achieve relative rotation. The first clamping member 20 may also be flexibly connected with the door 2 to achieve relative rotation. For example, a connecting member made of elastic material is used to connect the first clamping member 20 and the door 2, the rotation of the first clamping member 20 relative to the door 2 can be realized by the elastic deformation of the connecting member.

Preferably, the second clamping member 3 may be rotatably connected with the housing 1, and the size of the clamping area 4 can be changed by rotating the first clamping member 20 relative to the door 2 and rotating the second clamping member 3. The rotatable connection between the second clamping member 3 and the housing 1 is not limited. For example, a pivot connection, a matching connection between a pin and a pin hole, or a hinged connection may be adopted. The first clamping member 20 is rotatably connected with the door 2, the second clamping member 3 is rotatably connected with the housing 1, and the size of the clamping area 4 can be changed by rotating the first clamping member 20 and the second clamping member 3. Under the same clamping force, the rotation on both sides has less resistance to the pouch 101 when the pouch 101 is drawn out than the single-sided rotation, thereby avoiding squeezing the medicine in the pouch 101.

In the medicine box of Embodiment 1, the door 2, the first clamping member 20, and the second clamping member 3 are arranged on the top surface of the housing 1, and the first magnetic portion 200 and the second magnetic portion 300 are respectively arranged on the opposite ends of the first clamping member 20 and the second clamping member 3. The cavity 100 of the housing 1 is opened or closed through the rotation of the door 2. When the cavity 100 is opened, several pouches 101 connected in sequence can be placed in the cavity 100. When the cavity 100 is closed by the door 2, the first magnetic portion 200 and the second magnetic portion 300 are attracted through the magnetic force, that is, the first clamping member 20 and the second clamping member 3 are attracted through the magnetic force. On one hand, the relative fixation of the door 2 and the second clamping member 3 and the housing 1 can be realized, so there is no need to set an additional locking structure between the door 2, the second clamping member 3, and the housing 1. On the other hand, the clamping and fixing of the pouch 101 can also be realized, so there is no need to set an additional clamping structure for the pouch 101, which can greatly simplify the overall structure of the medicine box. Furthermore, when the pouch 101 is extracted, the change of the relative position of the first magnetic portion 200 and the second portion 300 causes the magnetic flux density to change, and the magnetic force also changes. Therefore, it can form the feedback of the resistance change that is opposite to the withdrawal direction and corresponding to the shape of the pouch 101 and that can be sensed by the hand, thereby helping the user to perceive and position the interval of the pouches 101.

In Embodiment 1, an end of the first clamping member 20 away from the door 2 extends outward to form the first magnetic portion 200 in a direction away from the cavity 100. An end of the second clamping member 3 away from the housing 1 extends outward to form the second magnetic portion 300 in a direction away from the cavity 100.

Figure 6:
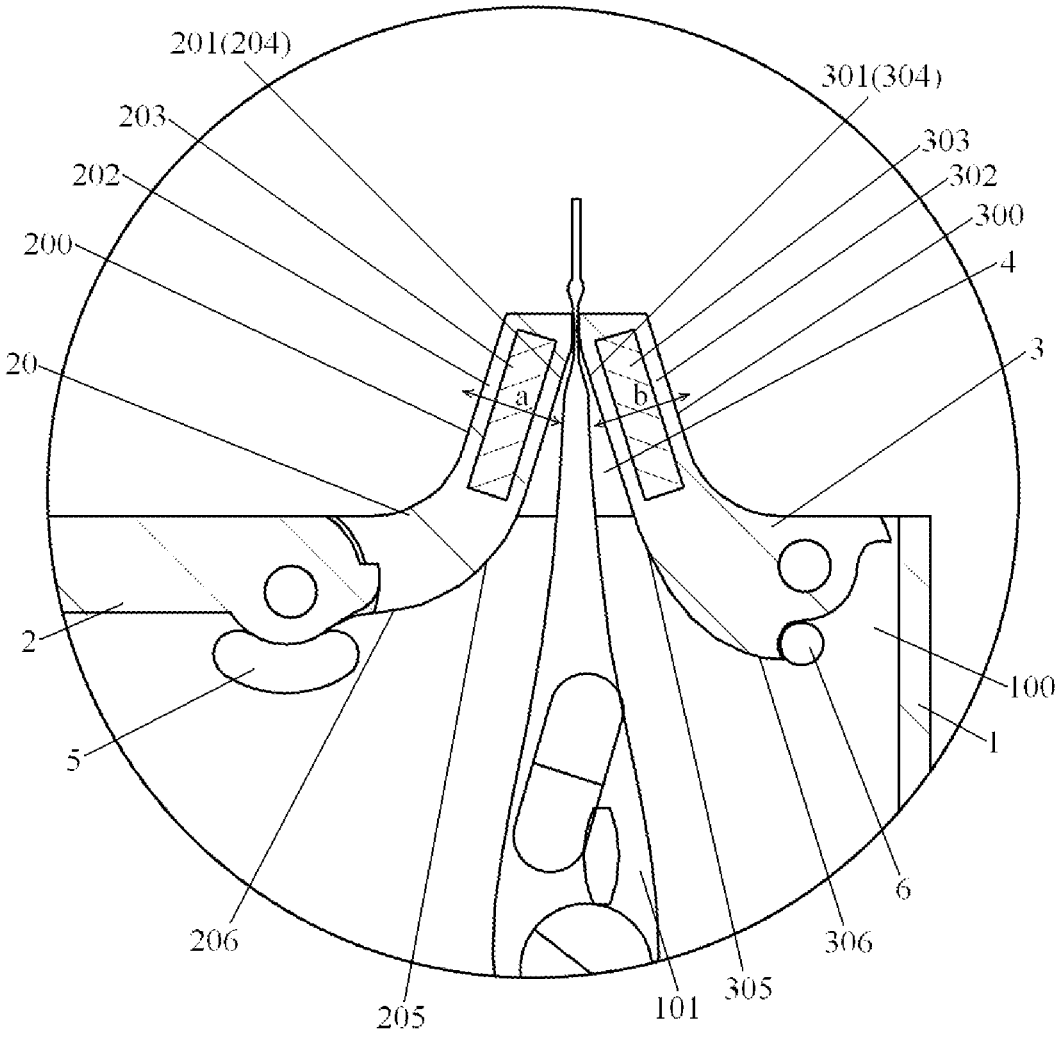
FIG. 6 is an enlarged schematic view of part A in FIG. 4.
Figure 7:
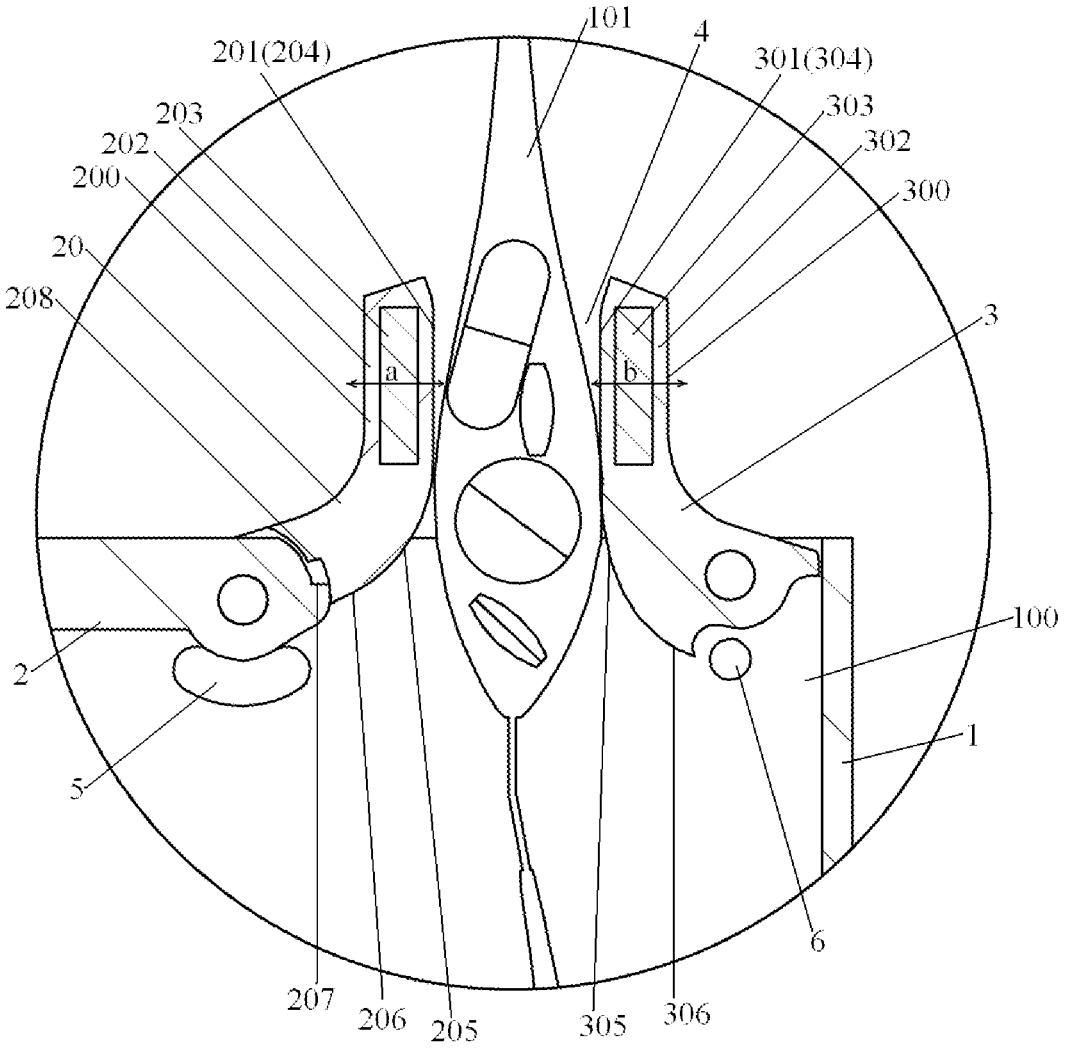
FIG. 7 is an enlarged schematic view of part B in FIG. 5.

Preferably, in Embodiment 1, referring to FIGS. 6 and 7, the first magnetic portion 200 includes a first magnetic surface 201 facing the cavity 100, the second magnetic portion 300 includes a second magnetic surface 301 facing the cavity 100, the first magnetic surface 201 and the second magnetic surface 301 are arranged at an angle opposite to each other, that is, the magnetic line direction a of the first magnetic portion 200 and the magnetic line direction b of the second magnetic portion 300 are arranged at an angle. Preferably, in Embodiment 1, the ends of the first magnetic surface 201 and the second magnetic surface 301 away from the cavity 100 may be in contact with each other. A clamping area 4 is formed between the first magnetic surface 201 and the second magnetic surface 301, and the clamping area 4 is formed in a horn shape that gradually opens toward the cavity 100.

Further, in Embodiment 1, the first magnetic portion 200 on the first clamping member 20 may include a first clamping portion 202 and a first magnet 203. The first clamping portion 202 is obtained by one end of the first clamping member 20 extending away from the door 2 in a direction away from the cavity 100. The first magnet 203 is embedded in the first clamping portion 202. The first magnet 203 can use a permanent magnet to provide magnetic force. The first clamping portion 202 includes a first clamping surface 204 formed as a first magnetic surface 201, and the first magnet 203 is arranged in parallel with the first clamping surface 204 inside the first clamping portion 202, thereby constituting the first magnetic portion 200.

Correspondingly, the second magnetic portion 300 on the second clamping member 3 may include a second clamping portion 302 and a second magnet 303. The second clamping portion 302 is obtained by one end of the second clamping member 3 extending away from the housing 1 in a direction away from the cavity 100. The second magnet 303 is embedded in the second clamping portion 302. The second magnet 303 can use a permanent magnet to provide magnetic force. The magnetic pole of the second magnet 303 is opposite to the magnetic pole of the first magnet 203. The second clamping portion 302 includes a second clamping surface 304 formed as a second magnetic surface 301, and the second magnet 303 is arranged in parallel with the second clamping surface 304 inside the second clamping portion 302, thereby constituting the second magnetic portion 300.

The manner in which the first magnetic portion 200 and the second magnetic portion 300 achieve magnetic attraction is not limited to the above-mentioned form, and other methods may also be used. For example, the first magnetic portion 200 and the second magnetic portion 300 may adopt an integral part with magnetic force, for example, the entire first magnetic portion 200 and the second magnetic portion 30 are made of permanent magnet materials, and the same effect can also be achieved. Further, the first clamping member 20 and the second clamping member 3 may also be integral members with magnetic force. For example, the same effect can be achieved if the first clamping member 20 and the second clamping member 3 are both members made of permanent magnet materials.

Further, in Embodiment 1, a first bottom surface 206 at an end of the first clamping member 20 connected with the door 2 is smoothly and transitionally connected with the first magnetic surface 201 of the first magnetic portion 200 through a first arc-shaped surface 205. A second bottom surface 306 at an end of the second clamping member 3 connected with the housing 1 is smoothly and transitionally connected with the second magnetic surface 301 of the second magnetic portion 300 through a second arc-shaped surface 305. Then, the first arc-shaped surface 205 and the second arc-shaped surface 305 can further guide the output of the pouch 101, so that pouch 101 can smoothly enter the clamping area 4.

Further, in Embodiment 1, the housing 1 has a first limiting structure to match with the door 2. The first limiting structure limits a bottom dead center position when the door 2 rotates toward the inside of the cavity 100, i.e., the lowest position to which the door 2 can be rotated toward the inside of the cavity 100 is limited, thereby restricting the rotation angle of the door 2 toward the inside of the cavity 100 and ensuring the effective closing of the cavity 100. The specific form of the first limiting structure is not limited. Preferably, the first limiting structure may be disposed on the wall of the cavity 100 inside the housing 1. For example, the first limiting structure may be a first boss 5 disposed on the wall of the cavity 100 inside the housing 1, and the bottom dead center position at which the door 2 rotates toward the inside of the cavity 100 is defined through the cooperation of the first boss 5 and the door 2. The matching manner of the first boss 5 and the door 2 is not limited. For example, the first boss 5 can be set at a position corresponding to the middle of the door 2, and when the door 2 rotates toward the inside of the cavity 100, the bottom dead center position at which the door 2 rotates toward the inside of the cavity 100 can be defined by the snap-fit contact between the bottom surface of the door 2 facing the cavity 100 and the first boss 5. Referring to FIGS. 5 and 6, the first boss 5 can also be set at a position corresponding to an end of the door 2 connected with the first clamping member 20, and when the door 2 rotates toward the inside of the cavity 100, the bottom dead center position at which the door 2 rotates toward the inside of the cavity 100 can be defined by the snap-fit contact between the end of the door 2 connected with the first clamping member 20 and the first boss 5.

Further, in Embodiment 1, a second limiting structure is disposed between matching surfaces of the door 2 and the first clamping member 20, and the second limiting structure limits a bottom dead center position (i.e., the lowest position to which the first clamping member 2 can be rotated toward the inside of the cavity 100) when the first clamping member 20 rotates toward the inside of the cavity 100, thereby restricting the rotation angle of the first clamping member 20 toward the inside of the cavity 100. The specific form of the second limiting structure is not limited. Preferably, referring to FIGS. 6 and 7, a first step surface 207 may be disposed on an end surface of the door 2 away from the housing 1, a second step surface 208 is disposed on an end surface of the first clamping member 20 connected with the door 2, and the second step surface 208 and the first step surface 207 are engaged with each other to form the second limiting structure. When the first clamping member 20 rotates toward the inside of the cavity 100, the second step surface 208 on the first clamping member 20 approaches the first step surface 207 on the door 2. When the second step surface 208 and the first step surface 207 are clamped to each other, the first clamping member 20 can no longer continue to rotate toward the inside of the cavity 100. That is, the first clamping member 20 reaches the bottom dead center position when the first clamping member 20 rotates toward the inside of the cavity 100. The bottom dead center position is defined by the cooperation of the second step surface 208 and the first step surface 207.

Further, in Embodiment 1, the housing 1 has a third limiting structure to limit a bottom dead center position of the second clamping member 3 (i.e., the lowest position to which the second clamping member 3 can be rotated toward the inside of the cavity 100) when the second clamping member 3 rotates toward the inside of the cavity 100, thereby restricting the rotation angle of the second clamping member 3 toward the inside of the cavity 100. The specific form of the third limiting structure is not limited. Preferably, the third limiting structure may be disposed on the wall of the cavity 100 inside the housing 1. For example, the third limiting structure may be a second boss 6 disposed on the wall of the cavity 100 inside the housing 1. The bottom dead center position is defined through the cooperation of the second boss 6 and the second clamping member 3. The matching manner of the second boss 6 and the second clamping member 3 is not limited. Preferably, referring to FIGS. 5 and 6, the second boss 6 may be set at a position corresponding to a side of the second clamping member 3. When the second clamping member 3 rotates toward the inside of the cavity 100, the bottom dead center position may be defined by the snap-fit contact between the side surface of the second clamping member 3 and the second boss 6.

Furthermore, in Embodiment 1, a lifting grip 7 is disposed on the first clamping member 20 to facilitate the user to grasp and turn the door 2 to open the medicine box.

In the above medicine box of Embodiment 1, the first magnetic surface 201 of the first magnetic portion 200 on the first clamping member 20 and the second magnetic surface 301 of the second magnetic portion 300 on the second clamping member 3 are opposite to each other and arranged at an angle. Compared with the traditional magnetic attraction in which two opposite magnetic surfaces are arranged in parallel and in close contact, the following advantages can be achieved:

(1) The horn-shaped clamping area 4 can play a good role in guiding the output of the pouch 101.

(2) Compared with the method in which the two magnetic surfaces are parallel and attached to each other, the angle between the first magnetic surface 201 and the second magnetic surface 301 can make the magnetic pole separation stroke shorter when the pouch 101 of the same thickness passes through. That is, when the pouch 101 of the same thickness passes through, the distance between the two magnetic surfaces (that is, the thickness of the air gap between the two magnetic surfaces) has a smaller variation range, so that the magnetic force and clamping resistance will not change strongly, so as to ensure the smooth and safe output of the pouch 101.

(3) The mutual attraction between the first magnetic portion 200 and the second magnetic portion 300 is proportional to the square of the magnetic flux density (magnetic induction) in the air gap between the two magnetic force surfaces, is approximately inversely proportional to the square of the distance between the two magnetic surfaces (that is, the thickness of the air gap between the two magnetic surfaces), and is nonlinear. When the distance between the two magnetic surfaces is close to zero, the attractive force changes very sharply, and the two magnetic surfaces that fit too closely need a lot of force to be separated. The angle between the first magnetic surface 201 and the second magnetic surface 301 keeps a certain initial distance and air gap between the two magnetic surfaces. Therefore, it can ensure that the distance between the first magnetic surface 201 and the second magnetic surface 301 becomes larger, and the first magnetic surface 201 and the second magnetic surface 301 still maintain an attractive force large enough at the end far away from the cavity 100 to clamp pouches 101 of different thicknesses and at different parts. At the same time, the change of the attractive force between the first magnetic surface 201 and the second magnetic surface 301 during the process of drawing out the pouch 101 will be gentle.

(4) When the pouch 101 is drawn out, the first magnetic portion 200 and the second magnetic portion 300 rotate and separate to enlarge the clamping area 4 so that the pouch 101 can pass through. During the separation process, the first magnetic surface 201 and the second magnetic surface 301 gradually tend to be parallel (see FIG. 7). At the same time, the cross-sectional area of the air gap between the two magnetic surfaces becomes larger, which can effectively compensate and adjust the rapid attenuation of the clamping force caused by the increase in the distance between the two magnetic surfaces, so that the two magnetic surfaces still maintain a large attractive force when the distance between the two magnetic surfaces is far. If the initial states of the two magnetic surfaces are parallel, the effect is exactly opposite.

Figure 8A:
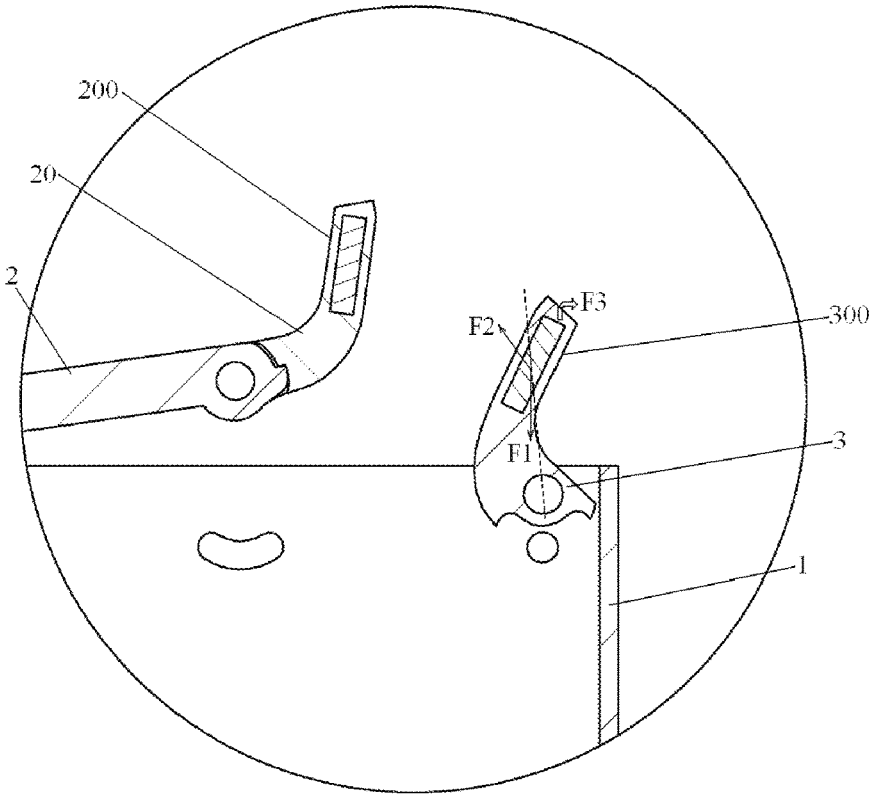
FIGS. 8*a* and 8*b* show schematic views of the linkage mechanism between the door and the second clamping member according to Embodiment 1 of the present disclosure.
Figure 8B:
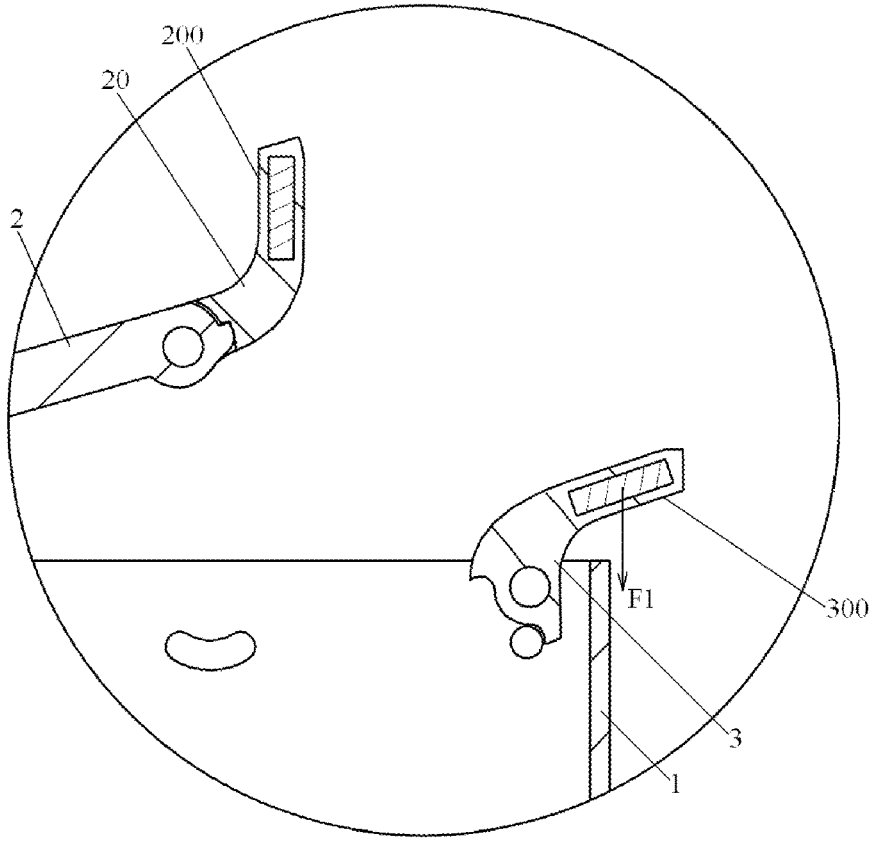

(5) The first magnetic surface 201 and the second magnetic surface 301 are opposite and arranged at an angle. When the cavity 100 is opened, the first magnetic portion 200 of the first clamping member 20 can be driven to rotate by rotating the door 2, to realize the linkage of the second magnetic portion 300 with the first magnetic portion 200, so that the second clamping member 3 also rotates in the opposite direction, the door 2 and the second clamping member 3 are opened or closed synchronously, and the operation is very convenient. Referring to FIGS. 8*a* and 8*b*, the principle is: according to the principle of the compass, the same poles attract each other, the different poles repel each other, and the north and south poles always tend to follow the flux direction of the applied magnetic field, making the attraction and repulsion collinear, thereby achieving a stable balance. In Embodiment 1, the position of the second clamping member 3 during the rotation is mainly determined by magnetic force and gravity. The gravity F1 of the second clamping member 3 is vertically downward, and the force of the door 2 on the second clamping member 3 is generated by the magnetic attraction between the first magnetic portion 200 and the second magnetic portion 300. The effect of the magnetic force received by the second magnetic portion 300 of the second clamping member 3 in the applied magnetic field of the first magnetic portion 200 of the first clamping member 20 can be decomposed into a force F2 that causes the second magnetic portion 300 to translate as a whole along the flux direction, and a torsional force (torque) F3 determined by the angle between its flux direction and the flux direction of the applied magnetic field. This torque is similar to the relationship between the compass and the earth's magnetic field. The north-south direction always tends to follow the flux direction of the applied magnetic field. Therefore, when the second clamping member 3 relatively rotates in the applied magnetic field of the first clamping member 20, these three forces (F1, F2, F3) will dynamically change. When the resultant force of these three forces is exactly collinear at the line connecting the center of mass and the axis of rotation of the second clamping member 3 (as shown by the dashed line in FIG. 8*a*), the force on the second clamping member 3 is balanced, and the second clamping member 3 is stabilized at this position (see FIG. 8*a*). Therefore, when the door 2 is lifted up and rotated, in the process of opening the door 2, the second clamping member 3 will overcome its own gravity and lift under the action of magnetic force, and follow the door 2 to rotate upward. When the door 2 is opened to a large enough angle, and the applied magnetic field of the second clamping member 3 is almost disappeared. At this time, the second clamping member 3 has passed the highest point and stabilized in the fully open position under the sole action of gravity F1 (see FIG. 8*b*). When the door 2 is closed, the magnetic field applied to the second clamping member 3 reappears, and the movement process is just the opposite. The second clamping member 3 will rotate following the door 2 and finally stop at the closed position.

Therefore, the medicine box of Embodiment 1 has the advantages of very simple structure, very convenient operation, and very good use effect and very reliable.

Further, the medicine box of Embodiment 1 may also include a pouch counting sensor. The pouch counting sensor may be arranged on the first magnetic portion 200 or the second magnetic portion 300, and the pouch counting sensor is connected with the controller for monitoring the user's medicine taking action. The pouch counting sensor may be a Hall sensor to detect the action of the first magnetic portion 200 or the second magnetic portion 300. Preferably, a photoelectric sensor may be disposed on the first magnetic portion 200 or the second magnetic portion 300 to assist in detecting the number of drawn pouches.

In addition, in Embodiment 1, a controller is disposed in the housing 1. A visible part on the housing 1, the door 2, the first clamping member 20, and/or the second clamping member 3 includes an information display device and/or medication reminder device, which are connected with the controller, to display the time, the doctor's medication notice information, and the medication reminder message.

Embodiment 2

FIGS. 9 to 12 show the second embodiment of the medicine box of the present disclosure. The Embodiment 2 is basically the same as the Embodiment 1, the similarities will not be repeated, and the differences are as follows.

Figure 9:
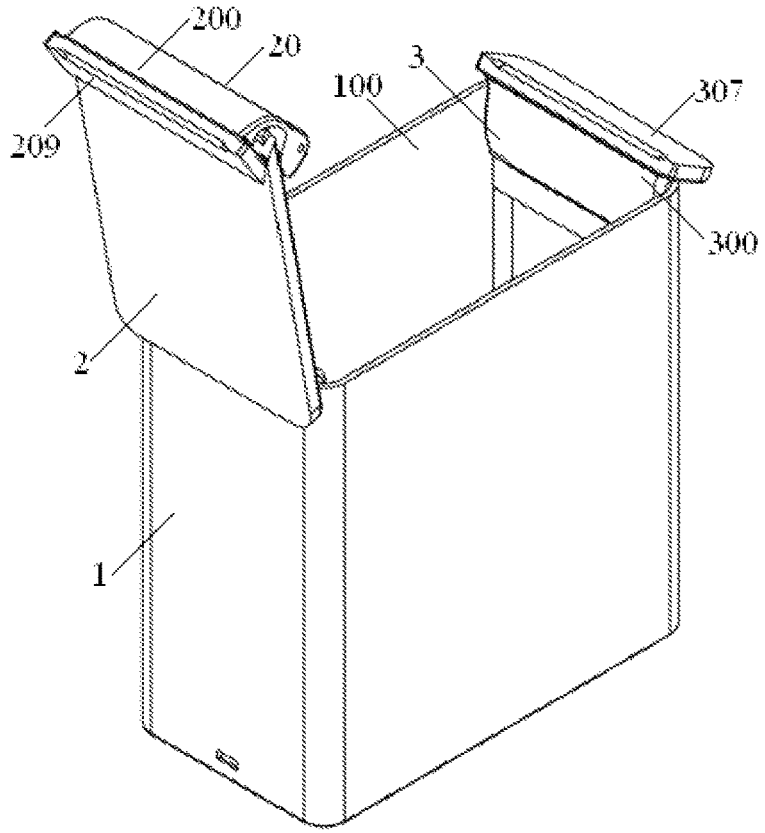
FIG. 9 shows a perspective schematic view of the medicine box when it is opened according to Embodiment 2 of the present disclosure.
Figure 10:
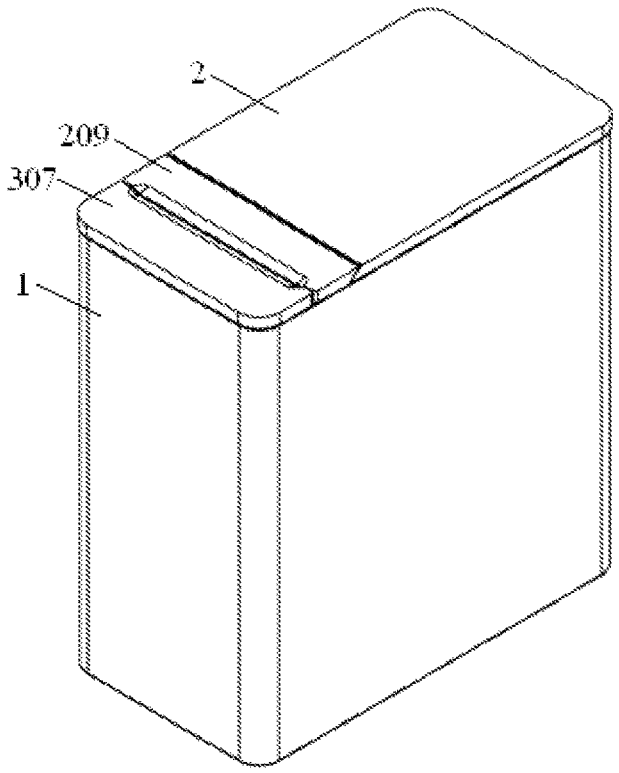
FIG. 10 shows a perspective schematic view of the medicine box when it is closed according to Embodiment 2 of the present disclosure.

Referring to FIGS. 9 and 10, in Embodiment 2, the door 2 is disposed on the top surface of the housing 1, and the door 2 has an expanded edge, so that the door 2 can cover the edge of the top surface of the housing 1. When the door 2 rotates toward the inside of the cavity 100, it can finally fall on and support on the top surface of the housing 1, which is the lowest position that the door 2 can rotate toward the inside of the cavity 100. Thus, the expanded edge of the door 2 constitutes the first limit structure, which limits the bottom dead center position when the door 2 rotates toward the inside of the cavity 100, and there is no need to set an additional limiting structure similar to the first boss 5 in Embodiment 1.

Figure 11:
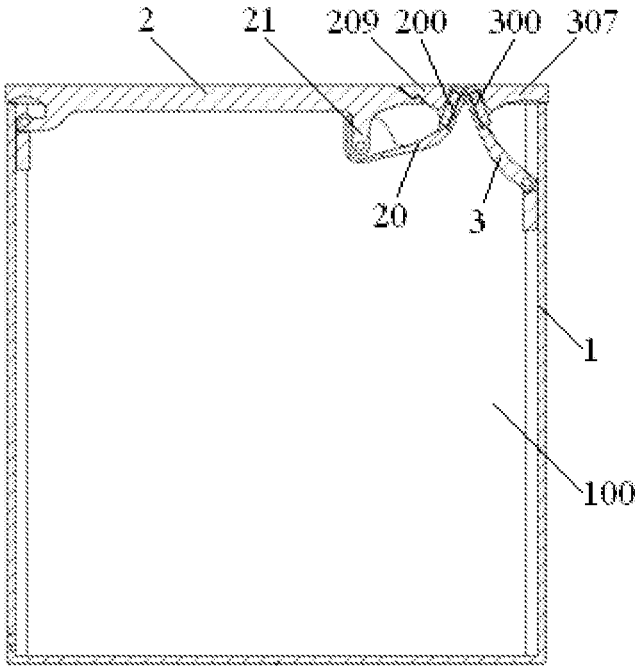
FIG. 11 shows a schematic cross-sectional view of the medicine box when it is closed according to Embodiment 2 of the present disclosure.
Figure 12:
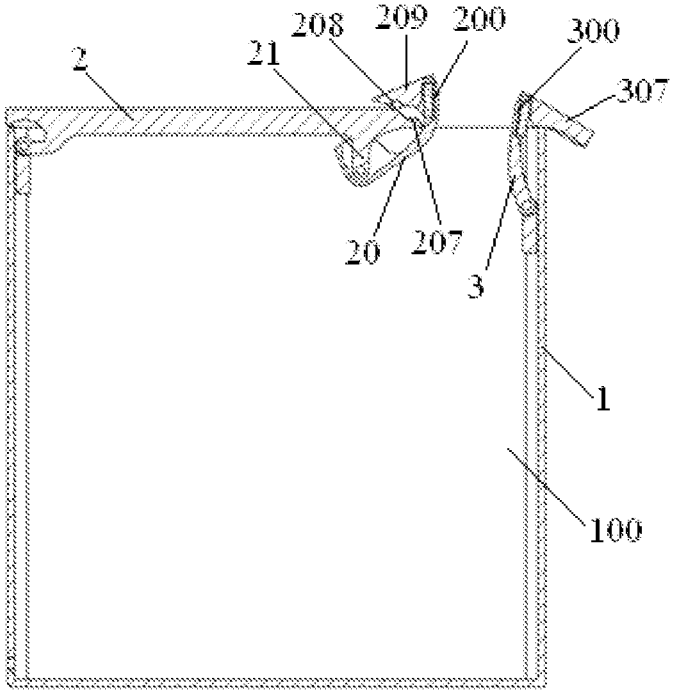
FIG. 12 shows a schematic cross-sectional view when the pouches are drawn out from the medicine box according to Embodiment 2 of the present disclosure.

Referring to FIGS. 11 and 12, in Embodiment 2, a connecting portion 21 extends downward on the lower surface of an end of the door 2 away from the housing 1. A first clamping member 20 is rotatably connected with the connecting portion 21. An end of a first magnetic portion 200 of the first clamping member 20 includes a first limiting portion 209, and the edge of the first limiting portion 209 can cover the top surface of the housing 1. When the first clamping member 20 rotates toward the inside of the cavity 100, the first limiting portion 209 can finally fall on and support on the top surface of the housing 1, which is the lowest position that the first clamping member 20 can rotate toward the inside of the cavity 100. Thus, the first limiting portion 209 constitutes a second limiting structure, which limits the bottom dead center position when the first clamping member 20 rotates toward the inside of the cavity 100. When the medicine box is in the closed state, the door 2 and the first limiting portion 209 of the first clamping member 20 are both supported on the top surface of the housing 1. In addition, a movable space is formed between the first clamping member 20 and the door 2 to allow the first clamping member 20 to rotate relative to the door 2. In Embodiment 2, a second limiting structure formed by the second stepped surface 208 engaging the first stepped surface 207 may be provided at the same time. The first stepped surface 207 is disposed on an end surface of the door 2 away from the housing 1. The second stepped surface 208 is disposed on an end surface of the first limiting portion 209 opposite to the door 2 to limit the rotation range of the first clamping member 20 relative to the door 2.

Referring to FIGS. 11 and 12, in Embodiment 2, the connection position of the second clamping member 3 and the housing 1 is set on the wall of the cavity 100 inside the housing 1. An end of the second magnetic portion 300 of the second clamping member 3 includes a second limiting portion 307, and the edge of the second limiting portion 307 can cover the top surface of the housing 1. When the second clamping member 3 rotates toward the inside of the cavity 100, the second limiting portion 307 can finally fall on and support on the top surface of the housing 1, which is the lowest position that the first clamping member 20 rotates toward the inside of the cavity 100. Thus, the second limiting portion 307 serves as a third limiting structure, which limits the bottom dead center position when the second clamping member 3 rotates toward the inside of the cavity 100. There is no need to set an additional limiting structure similar to the second boss 6 in Embodiment 1. When the medicine box is in the closed state, the second limiting portion 307 of the second clamping member 3 is supported on the top surface of the housing 1, and a movable space is formed between the second clamping member 3 and the housing 1 to allow the second clamping member 3 to rotate relative to the housing 1.

Thus, the Embodiment 2 makes the appearance of the medicine box more concise and flat while realizing that the first clamping member 20 is rotatably connected with the door 2 and the second clamping member 3 is rotatably connected with the housing 1.

The above are only the preferred embodiments of the present disclosure. It should be noted that for those skilled in the art, there can be several improvements without departing from the principle of the present disclosure. These improvements should also be regarded as the protection scope of the present disclosure.

We claim:

1. A medicine box, comprising a housing (1), a door (2), a first clamping member (20), and a second clamping member (3), wherein a cavity (100) is formed inside the housing (1), and the housing (1) has an opening on a top surface;

an end of the door (2) is rotatably connected with one side of the housing (1) at the opening, an end of the first clamping member (20) is connected with the other end of the door (2), and the other end of the first clamping member (20) includes a first magnetic portion (200);

an end of the second clamping member (3) is connected with the other side of the housing (1) at the opening, and the other end of the second clamping member (3) includes a second magnetic portion (300);

the first magnetic portion (200) and the second magnetic portion (300) are arranged opposite to each other and are attracted to each other by magnetic force, and a clamping area (4) with a changeable size is formed between the first magnetic portion (200) and the second magnetic portion (300).

2. The medicine box according to claim 1, wherein an end of the first clamping member (20) away from the door (2) extends outward to form the first magnetic portion (200) in a direction away from the cavity (100), and an end of the second clamping member (3) away from the housing (1) extends outward to form the second magnetic portion (300) in a direction away from the cavity (100).

3. The medicine box according to claim 2, wherein the first magnetic portion (200) includes a first magnetic surface (201) facing the cavity (100), the second magnetic portion (300) includes a second magnetic surface (301) facing the cavity (100), the first magnetic surface (201) and the second magnetic surface (301) are arranged at an angle opposite to each other, the clamping area (4) is formed between the first magnetic surface (201) and the second magnetic surface (301).

4. The medicine box according to claim 3, wherein the first magnetic portion (200) comprises a first holding portion (202) formed by the first clamping member (20) extending outward from an end away from the door (2) in a direction away from the cavity (100) and a first magnet (203) embedded in the first holding portion (202), the first clamping portion (202) includes a first clamping surface (204) formed as the first magnetic surface (201), and the first magnet (203) is arranged parallel to the first clamping surface (204).

5. The medicine box according to claim 3, wherein a first bottom surface (206) at an end of the first clamping member (20) connected with the door (2) is smoothly and transitionally connected with the first magnetic surface (201) of the first magnetic portion (200) through a first arc-shaped surface (205).

6. The medicine box according to claim 3, wherein the second magnetic portion (300) comprises a second holding portion (302) formed by the second clamping member (3) extending outward from an end away from the housing (1) in a direction away from the cavity (100) and a second magnet (303) embedded in the second holding portion (302), the second clamping portion (302) includes a second clamping surface (304) formed as the second magnetic surface (301), and the second magnet (303) is arranged parallel to the second clamping surface (304).

7. The medicine box according to claim 3, wherein a second bottom surface (206) at an end of the second clamping member (3) connected with the housing (1) is smoothly and transitionally connected with the second magnetic surface (301) of the second magnetic portion (300) through a second arc-shaped surface (305).

8. The medicine box according to claim 1, wherein the housing (1) has a first limiting structure matched with the door (2), and the first limiting structure limits a bottom dead center position when the door (2) rotates toward the inside of the cavity (100).

9. The medicine box according to claim 1, wherein the first clamping member (20) is rotatably connected with the door (2).

10. The medicine box according to claim 9, wherein a second limiting structure is disposed between matching surfaces of the door (2) and the first clamping member (20), and the second limiting structure limits a bottom dead center position when the first clamping member (20) rotates toward the inside of the cavity (100).

11. The medicine box according to claim 1, wherein the second clamping member (3) is rotatably connected with the housing (1).

12. The medicine box according to claim 11, wherein the housing (1) and the second clamping member (3) are matched by a third limiting structure, and the third limiting structure limits a bottom dead center position when the second clamping member (3) rotates toward the inside of the cavity (100).

13. The medicine box according to claim 1, wherein a pouch counting sensor is disposed on the first magnetic portion (200) or the second magnetic portion (300).

14. The medicine box according to claim 13, wherein a controller is disposed in the housing (1), a visible part on the housing (1), the door (2), the first clamping member (20), and/or the second clamping member (3) includes an information display device, the information display device is connected with the controller, and the pouch counting sensor is connected with the controller.

* * * * *